US008384000B2

(12) United States Patent
Ruffing et al.

(10) Patent No.: US 8,384,000 B2
(45) Date of Patent: Feb. 26, 2013

(54) APPARATUS FOR PROVIDING FOOD SERVICE

(75) Inventors: Katherine J. Ruffing, Evanston, IL (US); Julie A. Pedretti, Middleton, WI (US); Douglas A. Redmond, Middleton, WI (US); Suzy X. Zeng, Northfield, IL (US); Angela N. Dodge, Hoffman Estates, IL (US)

(73) Assignee: Kraft Foods Group Brands LLC, Northfield, IL (US)

( * ) Notice: Subject to any disclaimer, the term of this patent is extended or adjusted under 35 U.S.C. 154(b) by 1983 days.

(21) Appl. No.: 11/030,080

(22) Filed: Jan. 7, 2005

(65) Prior Publication Data

US 2006/0151487 A1 Jul. 13, 2006

(51) Int. Cl.
*H05B 6/80* (2006.01)
*F24C 1/16* (2006.01)

(52) U.S. Cl. ..... 219/725; 126/275 R

(58) Field of Classification Search ..... 219/725, 219/678, 620, 621; 221/150 HC, 150 A, 221/150 R; 186/44; 99/355, 332
See application file for complete search history.

(56) References Cited

U.S. PATENT DOCUMENTS

| | | | | |
|---|---|---|---|---|
| D191,024 | S | 8/1961 | Buday | |
| 3,381,605 | A | 5/1968 | Smith | |
| 3,534,676 | A | 10/1970 | Rubino | |
| 3,887,786 | A | 6/1975 | Witt et al. | |
| 4,004,712 | A | 1/1977 | Pond | |
| T973013 | I4 | 8/1978 | Ferrara et al. | |
| 4,592,485 | A | 6/1986 | Anderson et al. | |
| 4,783,582 | A | 11/1988 | Wada et al. | |
| 4,880,954 | A | 11/1989 | Bennett et al. | |
| 5,573,082 | A * | 11/1996 | Conlan et al. | 186/44 |
| 5,582,758 | A | 12/1996 | Smith et al. | |
| D438,403 | S | 3/2001 | Greenburg | |
| 6,399,925 | B1 * | 6/2002 | Pickering et al. | 219/452.13 |
| 6,431,628 | B1 * | 8/2002 | Bell, Jr. | 296/24.32 |
| 6,730,882 | B2 * | 5/2004 | Atkinson | 219/413 |
| 6,777,654 | B1 * | 8/2004 | Greenburg | 219/679 |
| 6,861,632 | B2 * | 3/2005 | Lee | 219/757 |
| 6,867,402 | B1 * | 3/2005 | Schulte | 219/704 |
| 2003/0205147 | A1 * | 11/2003 | Schackmuth et al. | 99/407 |
| 2004/0206752 | A1 | 10/2004 | Greenburg | |

* cited by examiner

*Primary Examiner* — Thor Campbell
(74) *Attorney, Agent, or Firm* — Fitch, Even, Tabin & Flannery LLP

(57) ABSTRACT

A food service apparatus is provided as an integral, self-contained assembly comprising a food storage unit adapted to contain a plurality of packaged food items under chilled conditions. There also is a countertop, including an exposed upper surface area, attached to the food storage unit. A cabinet module, defining at least one enclosure space, is attached to the countertop. An oven, operable to cook as food item, is removably placed in the at least one enclosure space. A food advertising module is attached to the cabinet module of the assembly.

20 Claims, 6 Drawing Sheets

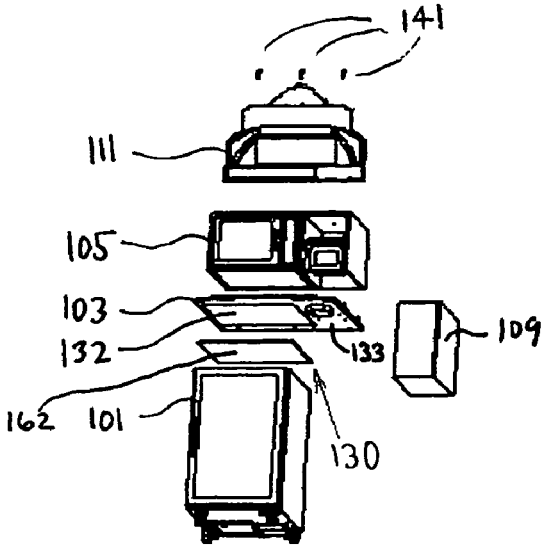
FIG.4
FIG.5
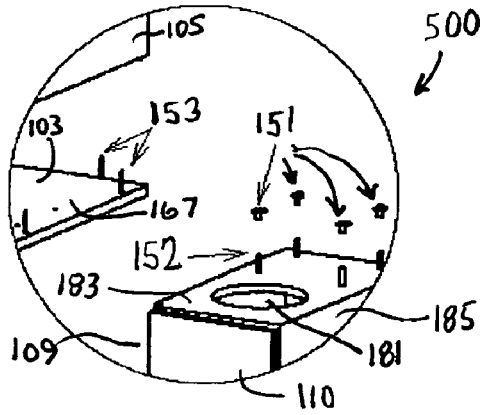
FIG.6
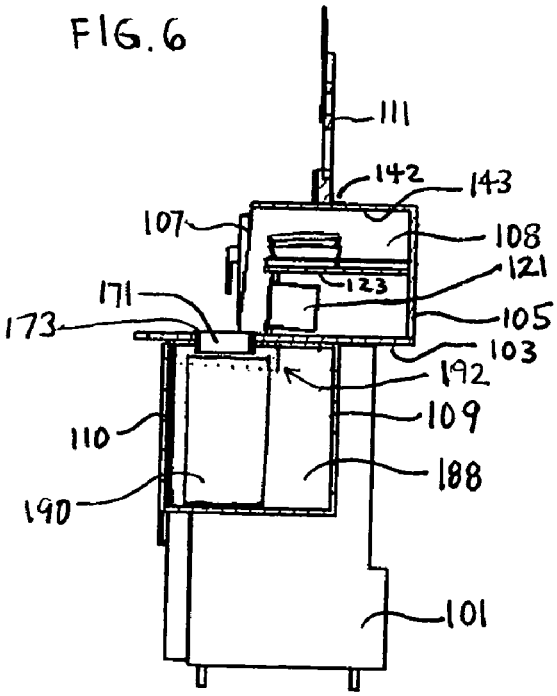

APPARATUS FOR PROVIDING FOOD SERVICE

FIELD OF THE INVENTION

This invention relates generally to an apparatus and method for providing food service, and more particularly to an apparatus and method for providing walk-up self-service of frozen or refrigerated convenience foods.

BACKGROUND OF THE INVENTION

There is significant consumer demand for packaged single serving food items which can be selected and prepared on-site by patrons themselves of retail stores. The patrons can then consume the cooked food items on-site or "on-the-go" either in a hand held manner, or with serving plates/bowls and eating utensils, whichever is convenient or desired. Retail stores have marketed food products which require a minimum amount of consumer preparation, and also have provided walk-up food preparation capabilities in which frozen foods are sold, cooked on-site, and then eaten on-site or off-site by patrons. For instance, preassembled frozen sandwiches, pizzas, burritos, etc., have been sold from freezers at retail locations which can be cooked or warmed up by customers on-site using a rapid heating oven, such as a microwave oven, provided at the same location. Freezing the sandwiches increases the product's shelf life and helps preserve the freshness of the product until defrosted and cooked. Heating the sandwiches not only defrosts the food items but also makes them more chewable and savory for the patron.

Convenience stores and other retail venues often have limited floor space available to install on-site frozen food storage and cooking equipment. Patrons commonly are provided a relatively limited area in the stores in which to prepare their frozen food selection and purchase for consumption. If greater food preparation areas are provided, it may come at the expense of product shelving or advertising display space available within the store. Also, patrons carrying out self-service cooking operations at convenience stores and the like often are pressed for time, and may not be very familiar with the provided cooking equipment and/or a selected food product. The cooking equipment generally will be used by many different patrons having varying levels of dexterity and familiarity with the particular cooking equipment provided at that location.

SUMMARY OF THE INVENTION

The invention provides an apparatus for self-service of foods. The apparatus is a combination providing everything needed for food storage, advertising, preparation, and service.

In one embodiment, a food service apparatus is provided as an integral modular assembly comprising a food storage unit adapted to contain a plurality of packaged food items under chilled conditions. There also is a countertop, including an exposed upper surface area, attached to the food storage unit. A cabinet module, defining at least one enclosure space, is attached to the countertop. An oven, operable to cook a food item, is removably placed in the at least one enclosure space. A food-advertising module is attached to the cabinet module of the assembly. The apparatus preferably is provided as an assembly of separably connected modules including at least the above-indicated components.

In a particular embodiment, the apparatus further includes a trash collection module attached to the cabinet module. The trash collection module includes sidewalls, a top side, a side door, an interior cavity defined by the sidewalls and top side which is accessible via the side door. A trash receptacle is removably placed in the cavity. The top side of the trash collection module may have a throughhole providing access to the receptacle in the cavity. The trash receptacle may be an open-mouthed elongate container slidably mountable on guide rails provided on inner surfaces of the top side or sidewalls allowing removable placement of the receptacle in the cavity at a location oriented below the throughhole.

In another particular embodiment, the apparatus further includes a mounting block attached between the storage unit and the countertop, wherein the countertop includes a recessed region in a surface thereof having a shape adapted to mechanically interfit the mounting block therein. In more particular embodiment, double-sided adhesive tape may be used to attach (i) the food storage unit to one side of the mounting block, and (ii) the opposite side of the mounting block to the recess in the countertop.

In another particular embodiment, the display module comprises signage attached to the cabinet module. The signage may include graphics identifying at least one food item contained in the food storage unit.

In another particular embodiment, the food storage unit includes an access door having a transparent portion adapted to allow food items stored within the food storage unit to be viewed from outside the food storage unit. The food storage unit may be a freezer or a refrigeration unit.

In another particular embodiment, the oven may be a microwave oven, convection oven, a hybrid oven combining microwave and convection heating means, a toaster, and so forth. The oven may comprise an electronic menu including at least one button pre-programmed to activate the oven to heat a corresponding food item from the storage unit for a predetermined set of heating conditions for that food item. More particularly, the oven may comprises a programmable cooking controller and a plurality of push control buttons associated with identifying means for a plurality of different types of food items stored in the food storage unit. The buttons are manually activatable to activate the controller to operate the oven to heat a selected type of frozen food item under predetermined cooking conditions corresponding to the selected type of frozen food item. The oven, and the food storage unit, may further comprise an electrical power outlet adapted for connection of electrical power transmission means thereto.

In another particular embodiment, the cabinet module further defines an additional enclosure space adapted to receive and store at least one food service item selected from the group consisting of napkins, trays, eating utensils, and food condiments.

In another embodiment, there is a method for providing food service, comprising (A) locating, at a desired food retail location, an apparatus such as exemplified herein, and (B) placing a plurality of food items in a food storage unit of the apparatus which are available for rapid preparation by patrons in an oven component of the apparatus and handling on an exposed surface area forming part of a countertop of the apparatus.

The self-service food apparatus of embodiments of the present invention may be used in convenience retail stores and other venues suited for walk-up and walk-away food service by patrons of the self-service units. In another embodiment, different kinds and/or shapes of food products can be cooked with the same apparatus.

The food items that can be merchandised with the apparatus are not particularly limited. In a particular embodiment, they are portable packaged food products including, for example, sandwiches, food wraps, pocket-type foods, enrobed foods, and other dough-containing food products, as well as meal dishes. These food products may include, for example, sandwiches (e.g., sandwich foods constructed with sliced bread, wraps, buns, or rolls, etc. and at least one edible filling such as meat, vegetable and/or dressing), gyros, burritos, egg rolls, pizzas, calzones, soy burgers, hot dogs, tacos, fajitas, nachos, meat pies, dumplings, pastries, pastry pies, meal dishes, and so forth.

BRIEF DESCRIPTION OF THE DRAWINGS

FIG. 4 is a front bottom exploded view of the apparatus of FIG. 1

FIG. 5 is an enlarged view of encircled area 500 in FIG. 3.

FIG. 6 is a right side sectional view of the apparatus of FIG. 1.

The figures are not necessarily drawn to scale. Similarly numbered elements in different figures represent like features unless indicated otherwise.

DETAILED DESCRIPTION OF THE PREFERRED EMBODIMENTS

Figure 1:
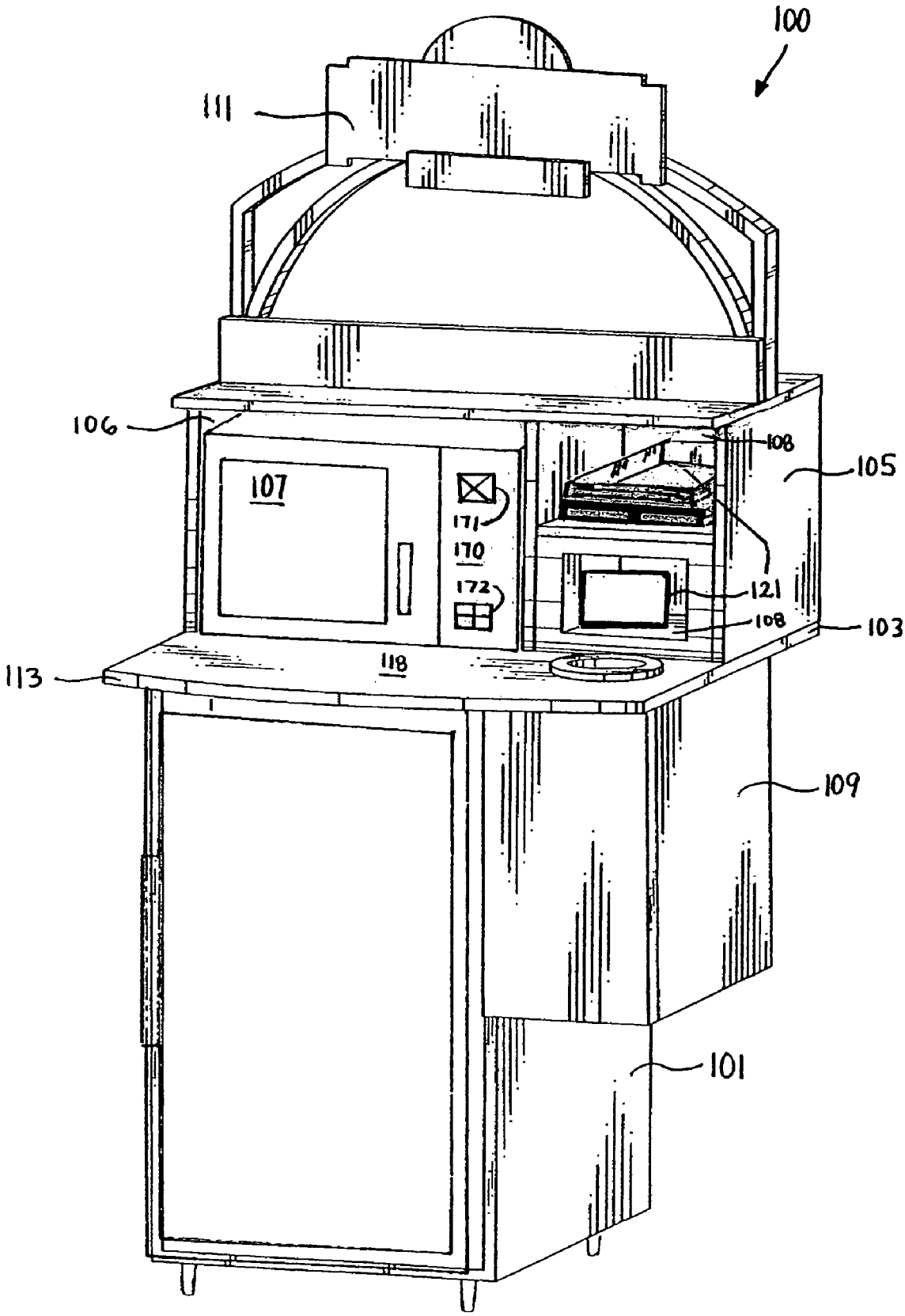
FIG. 1 is a right front perspective view of an apparatus for providing food self-service according to an embodiment of the invention.

Referring to FIG. 1, an apparatus 100 for providing self-service of food is illustrated. The food service apparatus 100 is provided as an integral modular assembly comprising a food storage unit 101, countertop 103, cabinet module 105 housing an oven 107, and trash collection module 109, and a food advertising display module 111. Additional food service items 121, such as napkins, food trays, eating utensils, food condiments (e.g., packets or packages of food dressings, sauces, seasonings, etc.), and so forth, also may be stored in the cabinet module 105, such as placed in an enclosure space 108 thereof. In this illustration, the countertop 103 includes a portion 113 providing an exposed table surface area 118 in the assembled apparatus 100. Also, the oven 107, which is removably housed in enclosure space 106, is illustrated as having an electronic menu 170 including a plurality of cooking control buttons 171 and 172. The apparatus 100 is a combination providing everything needed for food storage, advertising, food preparation, and self-service.

Figure 2:
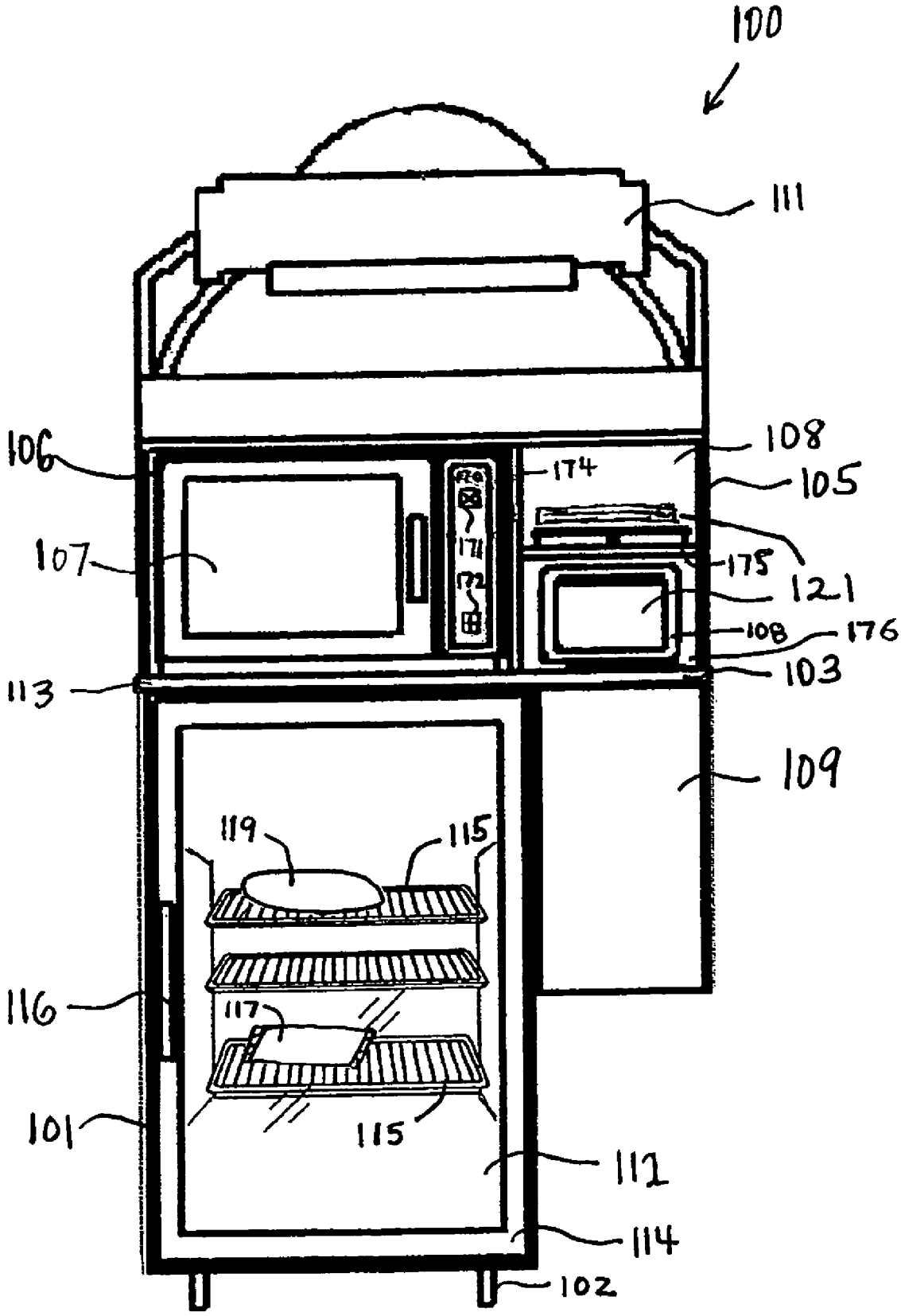
FIG. 2 is a front elevational view of the apparatus of FIG. 1.

Referring to FIG. 2, the food storage unit 101 may be a freezer or refrigerator, which may be powered via a standard power cord connected to an electrical power source via an electrical power outlet provided in the retail store or other installation location (not shown). The food storage unit 101 of apparatus 100 contains racks 115 for storage of a plurality of packaged food items 117 (e.g., a burrito) and 119 (e.g., a pizza) under chilled conditions. It will be appreciated that other types and amounts of packaged foods can be stored in the food storage unit 101, if space permits. The food items that can be merchandised with the apparatus are not particularly limited. In a particular embodiment, they are packaged food products including, for example, sandwiches, food wraps, pocket-type foods, enrobed foods, and other dough-containing food products, as well as meal dishes or other portable foods. These food products may include, for example, sandwiches (e.g., sandwich foods constructed with sliced bread, wraps, buns, or rolls, etc. and at least one edible filling such as meat, vegetable and/or dressing), gyros, burritos, egg rolls, pizzas, calzones, soy burgers, hot dogs, tacos, fajitas, nachos, meat pies, dumplings, pastries, pastry pies, meal dishes, and so forth.

The food storage unit 101 has a transparent portion 112 on its front door 114 which has a handle 116 provided to aid opening and closing the door. The transparent portion 112 (e.g., a glass or plastic window) permits patrons to view the types and amounts of food items available in the food storage unit 101 for selection without needing to open the storage unit door 114. The racks 115 may be expandible/contractible to fit around a food product. The food products also may be stored in feeder racks of a conventional type used in retail freezers or refrigerators (not shown). A space also may be provided within the food storage unit to hold an extra supply of food products available to be placed into feeder racks if they become empty. The food storage unit also may have an internal light source, e.g., a light bulb, which stays illuminated even when the access door of the food storage unit is closed. The food storage unit also may have a pre-programmed or manually activatable defrost cycle to keep the window free from condensation. All components in the food storage unit can be configured to be easily adjusted to accommodate additional food products. The food storage unit 101 is illustrated as having bottom support legs 102. The supports 102 also may comprise wheels, e.g., caster wheels, which may be operable to be releasably locked into fixed position.

As indicated, the countertop 103 includes a portion 113 thereof which protrudes and extends laterally away from other modules of the apparatus 100 (including at least the cabinet module 105 and oven 107 housed therein), providing an exposed generally horizontal table surface area 118 upon which a customer can handle and prepare a food selection, and/or set other belongings down while preparing a food selection. The countertop 103 also may include portions which overhang food storage unit 101 and trash collection module 109 (e.g., see FIG. 6).

The countertop 103 may be constructed of a rigid unitary board, slab, panel or laminate construction, e.g., wood, particle board, oriented strand board, veneer laminate, polymer, fiber-reinforced polymer, etc. As will be appreciated, composite and laminate panels may be molded to a desirable shape during manufacture.

The cabinet module 105 is attached to the countertop 103, and defines enclosure space 106 in which the oven 107 is housed. In this illustration, the oven 107 is surrounded by cabinetry except on the front side, allowing the customer access to an oven door and operational buttons. That is, the cabinet module 105 includes right and left sidewalls, a rear wall, a top side, and a bottom side integrally connected together (e.g., also see FIGS. 3-4). Oven 107 is operable to rapidly cook a food item (e.g., within about 15 minutes), is removably placed in the enclosure space 106. The oven 107 may be a microwave oven, convection oven, a hybrid oven combining microwave and convection heating means, a toaster, and so forth. The oven 107 may be powered via a standard power cord, such as one run through an opening providing in a rear wall of the cabinet module 105 to an electrical power source via an electrical power outlet provided in the retail store or other installation location (not shown).

As indicated, the oven 107 may comprise an electronic menu 170 including a plurality of buttons 171 and 172 each pre-programmed to activate the oven 107 to heat a corresponding food item from the storage unit for a predetermined set of heating conditions (e.g., heating time, power, etc.) for a given food item. The oven 107 may include a programmable or preprogrammed electronic cooking controller, and visual identifying means provided on the electronic menu 170 next to each of the plurality of push control buttons 171 and 172 identifying one of the plurality of different types of food items stored in the food storage unit. The buttons 171 and 172 are manually activatable to activate the controller to operate the oven to heat a selected type of frozen food item under predetermined cooking conditions corresponding to the selected type of frozen food item. Thus, different kinds and/or shapes of food products can be cooked with the same oven aboard the apparatus. It will be appreciated that a lesser or greater number of such push button controls may be provided.

The cabinet module 105 may further define an additional enclosure space 108 adjacent the oven 107, which is adapted to receive and store at least one food service item selected from the group consisting of napkins, eating utensils, food trays (e.g., finished product boxes which customers can use for take-out of cooked food products), and food condiments. In this non-limiting illustration, a vertical divider wall 174 in the cabinet module 105 separates enclosure spaces 106 and 108. In this non-limiting illustration, the enclosure space 108 is subdivided into two vertically aligned subcompartments separated by a horizontal divider 175, and the lower subcompartment thereof may have a framed front face 176 defining an opening into the subcompartment as illustrated. There also may be additional space provided on top of the cabinet module 105 allowing a customer to set things down while preparing a food product. Instructions on operation of the oven can also be displayed there.

The cabinet module 105 may be an enclosure constructed from rigid boards or panels cut or manufactured to appropriate sizes suitable to be assembled into an integral enclosure configuration. The board or panel material may be, e.g., wood, particle board, veneer laminate, oriented strand board, polymer, fiber-reinforced polymer, etc. It also may manufactured as a single molded piece, e.g., a molded polymer or fiber-reinforced polymer material, etc.

The food-advertising display module 111 is attached to the cabinet module 105 of the food kiosk assembly 100. The display module 111 may comprise signage including graphics identifying at least one food item contained in the food storage unit 101. For example, a menu board also may be displayed on the display module 111. The graphics displayed on the display module 111 may identify a food type, food brand, display a menu board, and/or other advertising (e.g., meal deals, specials, other offers).

The display module 111 may be constructed of rigid or semi-rigid components, e.g., metal, wood, particle board, oriented strand board, veneer laminate, polymer, fiber-reinforced polymer, paperboard, etc., or combinations thereof. For instance, the display module may comprise an aluminum grid bearing advertising graphics integrally connected to a mounting block at its base for attachment to the cabinet module 105.

The apparatus 100 may further include a trash collection module 109 attached to the cabinet module 105. The trash collection module 105 may have a cabinet construction including sidewalls and an upper surface which may be made of a rigid board, panel, or laminate material, e.g., wood, particle board, oriented strand board, polymer, fiber-reinforced polymer, etc. The trash collection module 109 also has other features such as described in more detail below with reference to FIGS. 3-6.

Figure 3:
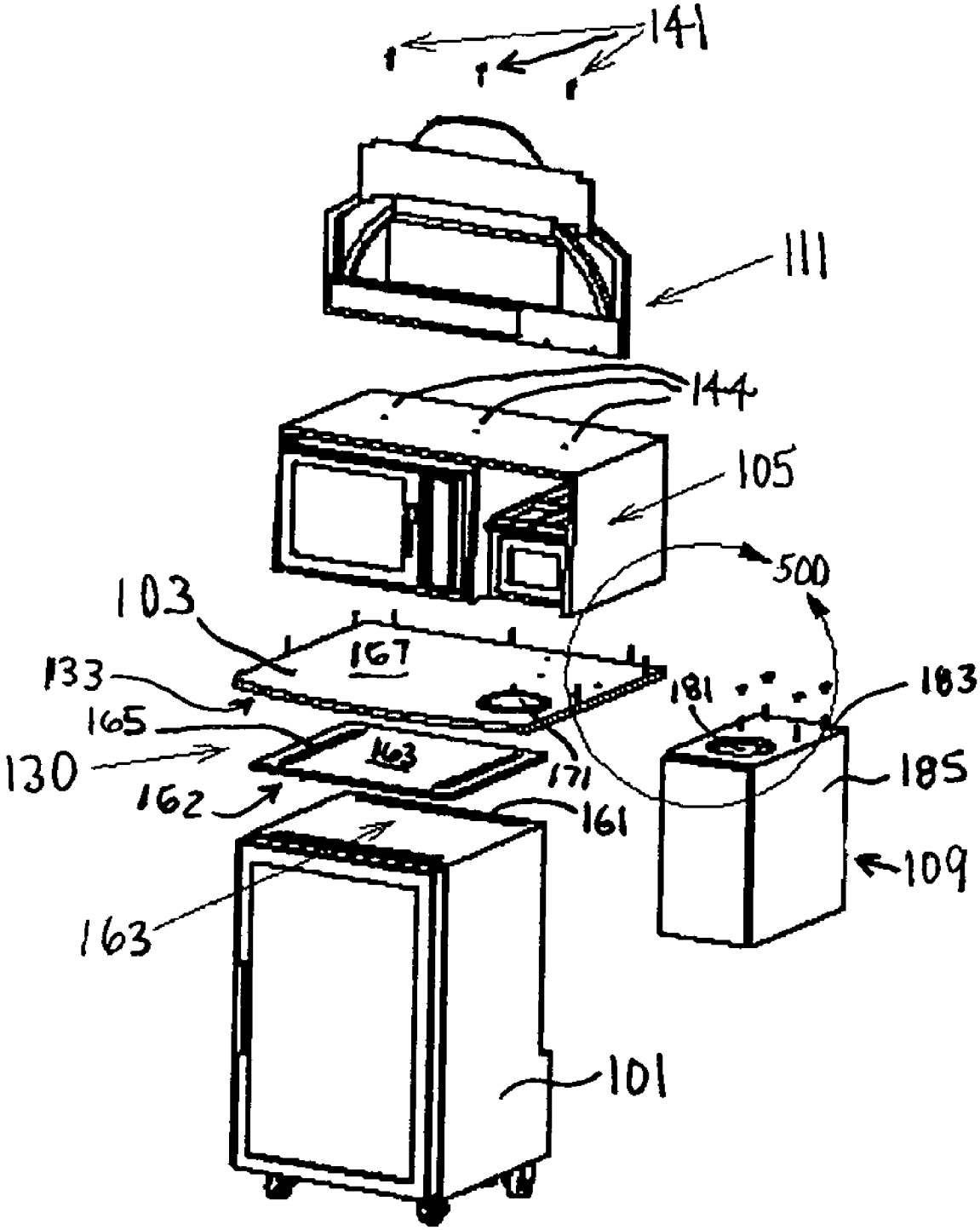
FIG. 3 is a front top exploded view of the apparatus of FIG. 1.

Referring to FIG. 3, the apparatus 100 may be provided as an assembly of separably connected modules including at least the above-indicated components. The display module 111 may be separably connected to the cabinet module 105, such as, for example, by using thumbscrews 141 which inserted through a flanged portion 142 of the display module and connected to an upper surface 143 of the cabinet module 105 via guide holes 144 provided therein (also see FIG. 6). The countertop 103 has a throughhole 171 which aligns with a throughhole 181 provided in the trash collection module 109 when the apparatus 100 is assembled together.

To facilitate the assembly of the modules, a mounting block 130 is attached between the food storage unit 101 and the countertop 103. The mounting block 130 may be adhesively and mechanically interconnected between the food storage unit 101 and countertop 103. In this non-limiting illustration, several strips of double-sided adhesive tape 161 are applied to the top surface 163 of the food storage unit 101. The bottom surface 162 of the mounting block 130 is pressed onto the adhesive tape 161 and top surface 163 of the food storage unit 101. Several strips of double-sided adhesive tape 165 are applied to top surface 163 the mounting block 130, which is pressed onto the lower surface 133 of the countertop 103. As will be appreciated, the double-sided adhesive tape 161 alternatively or additionally can be applied to the bottom surface 162 of the mounting block 130, and the double-sided adhesive tape 165 alternatively or additionally can be applied to the lower surface 133 of the countertop 103. The double-side adhesive tape 161 and 165 may be, for example, 2400 series tape, 3M Company, St. Paul, Minn.

Referring to FIG. 4, the countertop 103 also includes a recessed or relief region 132 in the bottom surface 133 thereof having a shape adapted to conformably receive and mechanically interfit the mounting block 130 therein.

Referring to FIG. 5, the cabinet module 105 may be attached to the upper surface 167 of the countertop 103, such by use of wood screws 153. The trash collection module 109 is separably connected to countertop 103, such as by use of prop nuts 151 and pan heads 152. The trash collection module 109 includes a top side 183 defining throughhole 181, sidewalls 185, and a side door 110.

Referring to FIG. 6, a flanged rubber or plastic sleeve 173 having a downward extending portion may be fitted to throughhole 171 in the countertop 103 to extend through throughhole 181 of the trash collection module 109 and into an interior cavity 188 defined by the sidewalls 185 and top side 183 of the trash cabinet 109. This feature can help to direct trash into a trash receptacle 190 removably stored within the trash collection module 109. Patrons may conveniently and cleanly deposit trash into the trash receptacle 190 via countertop throughhole 171 and throughole 181 of the trash collection module 109. The trash receptacle 190 is readily accessible from the front of the apparatus 100 via a hinged side door 110. This allows for easy clean up and disposal of waste. The trash receptacle 190 may be an open-mouthed elongate container.

The trash receptacle 190 may have a pull-out configuration with the trash collection module 109. For example, the trash receptacle 190 may have a flanged or collared mouth adapted to allow it to be slidably mounted and maneuvered in and/or out of the cavity 188 on guide rails 192 or similar means provided on inner surfaces of the top side 183 and/or sidewalls 185 of trash collection module 109. The guide rails 192 may include or be associated with a backstop which delimits movement of the trash receptacle 190 into cavity 188 at a location directly beneath the throughholes 181 and 171 in a generally aligned orientation of these features.

The food service item 121 may be napkins dispensed from a napkin dispenser 123, such as a standard device which feeds napkins out via a spring loaded paddle. Food trays and/or food condiments may be stacked on top of the napkin dispenser 123.

Figure 7:
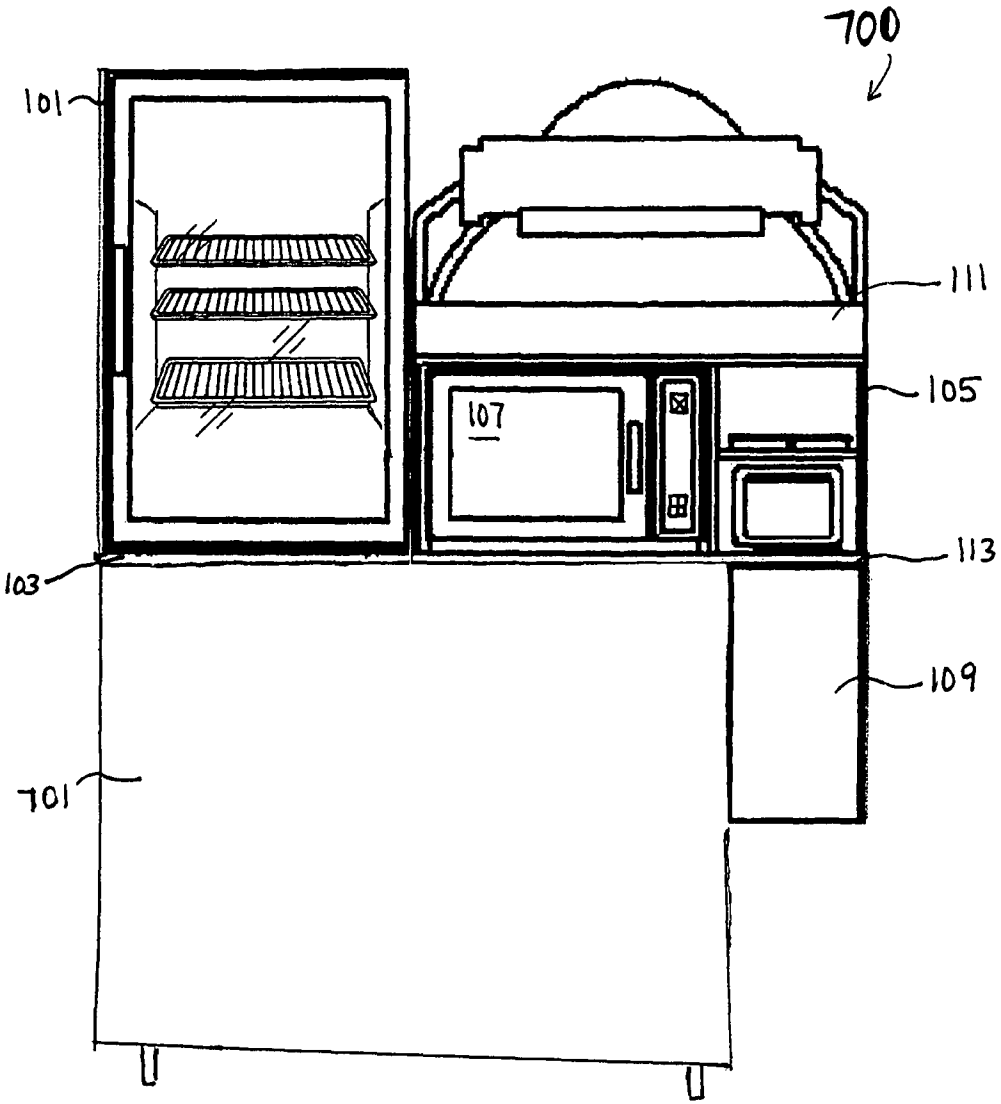
FIG. 7 is a front elevational view of an alternative configuration of an apparatus for providing food self-service according to another embodiment of the invention.

Although the apparatus 100 in FIGS. 1-6 is exemplified in a configuration in which the cabinet module 105 enclosing the oven 107 is vertically stacked over the food storage unit 101 with the intervening countertop 103, it will be appreciated that other configurations of the various modules may be provided. For instance, the food storage unit may be positioned vertically above the oven with the intervening countertop. With reference to FIG. 7, the food self-service apparatus 700 also may be configured such that the cabinet module 105 enclosing the oven 107, and the food storage unit 101, are positioned laterally side-by-side above a common platform 701, and the countertop 103 can be attached between a top surface of the platform 701 and lower surface(s) of one or both of the food storage unit 101 and cabinet module 105 enclosing the oven 107. In the apparatus of FIG. 1 or 7, the microwave oven or other oven effectively is positioned upon a platform that is used to elevate the oven equipment off the floor, allowing for improved air circulation and improved cooking. This helps to ensure that food can be cooked to reach a high temperature in the oven in a short period time, e.g., within minutes. The apparatus alternatively can be designed to sit on the floor or a countertop and provide all needed food service items (napkins, garbage can, etc).

Figure 8:
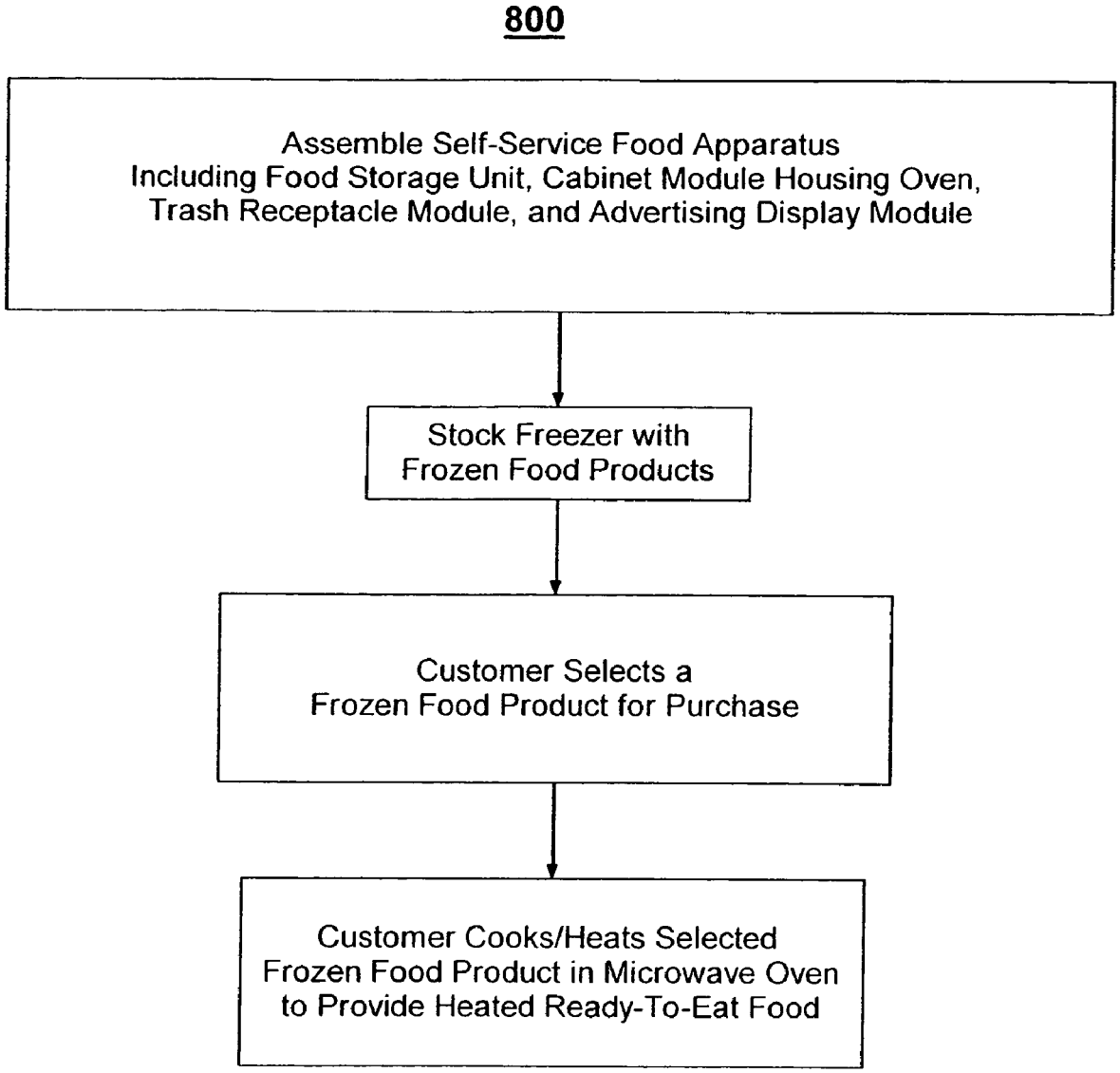
FIG. 8 is a flow chart for a method using the apparatus of FIG. 1 or FIG. 7 to provide self-service of food products according to another embodiment of the present invention.

Referring to FIG. 8, there is a method 800 for providing food service, comprising (A) locating, at a desired food retail location, an apparatus 100 or 700 such as described herein, in which the apparatus may be pre-assembled and shipped as an integral unit to the location, or alternatively it may be shipped as an unassembled kit which is assembled on site; and (B) placing a plurality of food items in the food storage unit of the apparatus which are available for selection and rapid preparation by patrons in the oven component of the apparatus and handling on the exposed preparation surface forming part of the countertop of the apparatus.

The food apparatus of embodiments of the present invention is a stand-alone food delivery system which may be used in convenience retail stores and other venues suited for walk-up and walk-out/walk-away food service by patrons of the self-service units. Patrons can select a food product of their choice from food storage equipment, prepare and cook it themselves in the cooking device, and obtain food service items from the apparatus as needed or desired by themselves. The apparatus provides all needed items for patrons or customers to prepare and cook their own food in one convenient location. The apparatus is a modular assembly which can be pre-assembled and shipped as an integral unit to a retail location, or moved from one retail location to another as a single unit, or alternatively it may be shipped as individual modules for easy assembly on site. In addition to the components described above, the apparatus may also have other appendages that can hold merchandising, advertising, and menu boards that can be interchanged or customized to the establishments offering.

While the invention has been particularly described with specific reference to particular process and product embodiments, it will be appreciated that various alterations, modifications and adaptations may be based on the present disclosure, and are intended to be within the spirit and scope of the present invention as defined by the following claims.

What is claimed is:

1. An apparatus for providing food service, comprising:

a food storage unit adapted to contain a plurality of packaged food items under chilled conditions;

a countertop, including an exposed upper surface area, attached to the food storage unit;

a cabinet module, defining at least one enclosure space, attached to the countertop;

an oven, operable to cook a food item, removably placed in the at least one enclosure space; and a food advertising module attached to the cabinet module;

a trash collection module attached to the cabinet module, wherein the trash collection module includes sidewalls, a top side, a side door, an interior cavity defined by the sidewalls and top side and accessible via the side door, a trash receptacle removably placed in the cavity, wherein the top side has a throughhole providing access to the receptacle in the cavity; and wherein the trash receptacle comprises an open-mouthed elongate container slidably mountable on guide rail means provided on inner surfaces of the top side or sidewalls allowing removable placement of the receptacle in the cavity at a location oriented below the throughhole.

2. An apparatus for providing food service, comprising:

a food storage unit adapted to contain a plurality of packaged food items under chilled conditions;

a countertop, including an exposed upper surface area, attached to the food storage unit;

a cabinet module, defining at least one enclosure space, attached to the countertop;

an oven, operable to cook a food item, removably placed in the at least one enclosure space; and a food advertising module attached to the cabinet module; and a mounting block attached between the food storage unit and the countertop, wherein the countertop includes a recessed region in a surface thereof having a shape adapted to interfit the mounting block therein.

3. The apparatus of claim 1, wherein the food advertising module comprises signage separably attached to an upper surface of the cabinet module, wherein the signage includes graphics identifying at least one food item contained in the food storage unit.

4. The apparatus of claim 1, wherein the food storage unit includes an access door having a transparent portion adapted to allow food items stored within the food storage unit to be viewed from outside the food storage unit.

5. The apparatus of claim 1, wherein the food storage unit comprises a freezer.

6. The apparatus of claim 1, wherein the oven comprises a microwave oven.

7. The apparatus of claim 1, wherein the oven comprises an electronic menu including at least one button pre-programmed to activate the oven to heat a corresponding food item from the storage unit for a predetermined set of heating conditions for that food item.

8. The apparatus of claim 1, wherein the oven comprises a programmable cooking controller and a plurality of push control buttons associated with identifying means for a plurality of different types of food items stored in the storage unit, wherein the buttons are manually activatable to activate the controller to operate the oven to heat a selected type of frozen food item under predetermined cooking conditions corresponding to the selected type of frozen food item.

9. The apparatus of claim 1, wherein the apparatus comprises a separably connected unitary combination thereof.

10. The apparatus of claim 1, wherein the cabinet module further defining an additional enclosure space adapted to receive and store at least one food service item selected from the group consisting of napkins, trays, eating utensils, and food condiments.

11. An apparatus for providing food service, comprising:

a food storage unit adapted to contain a plurality of packaged food items under chilled conditions;

a countertop, including an exposed upper surface area, attached to the food storage unit;

a cabinet module, defining at least one enclosure space, attached to the countertop;

an oven, operable to cook a food item, removably placed in the at least one enclosure space; and a food advertising module attached to the cabinet module; and wherein the oven further comprises an electrical power outlet adapted for connection of electrical power transmission means thereto.

12. The apparatus of claim 1, wherein the food storage unit further comprises an electrical power outlet adapted for connection of electrical power transmission means thereto.

13. The apparatus of claim 1, wherein the cabinet module is vertically stacked over the food storage unit with the countertop positioned therebetween.

14. The apparatus of claim 1, wherein the food storage unit is vertically stacked over the cabinet module with the countertop positioned therebetween.

15. The apparatus of claim 1, wherein the cabinet module and food storage unit are positioned laterally side-by-side above a common platform, wherein the countertop is attached between a top surface of the platform and at least one lower surface of one or both of the food storage unit and cabinet module.

16. The apparatus of claim 1, wherein the food storage unit further comprises bottom support legs comprising wheels operable to be releasably locked in fixed position.

17. The apparatus of claim 1, wherein the food storage unit comprises a refrigerator.

18. A method for providing food service, comprising:

(A) locating, at a desired food retail location, an integral food service apparatus comprising:

a food storage unit operable to contain a plurality of packaged food items under chilled conditions, a countertop, including an exposed upper surface area, attached to the food storage unit;

a cabinet module, defining at least one enclosure space, attached to the countertop, an oven, operable to cook a food item, removably placed in the at least one enclosure space, a food advertising module attached to the cabinet module; and (B) placing a plurality of food items in the food storage unit; and wherein the apparatus is provided to further include a trash collection module attached to the cabinet module, wherein the trash collection module includes sidewalls, a top side, a side door, an interior cavity defined by the sidewalls and top side and accessible via the side door, a trash receptacle removably placed in the cavity, wherein the top side has a throughhole providing access to the receptacle in the cavity.

19. The method of claim 18, wherein the oven is provided to further include an electronic menu including at least one button pre-programmed to activate the oven to heat a corresponding food item from the storage unit for a predetermined set of heating conditions for that food item.

20. A method for providing food service, comprising:

(A) locating, at a desired food retail location, an integral food service apparatus comprising:

a food storage unit operable to contain a plurality of packaged food items under chilled conditions, a countertop, including an exposed upper surface area, attached to the food storage unit;

a cabinet module, defining at least one enclosure space, attached to the countertop, an oven, operable to cook a food item, removably placed in the at least one enclosure space, a food advertising module attached to the cabinet module; and (B) placing a plurality of food items in the food storage unit; and wherein the apparatus is provided to further include a mounting block attached between the food storage unit and the countertop in the apparatus, wherein the countertop includes a recessed region in a surface thereof having a shape adapted to mechanically interfit the mounting block therein.

* * * * *